US005245854A

United States Patent [19]

Bruggink et al.

[11] Patent Number: 5,245,854

[45] Date of Patent: Sep. 21, 1993

[54] PRESS TOOL AND AN ADAPTOR AND A PRESS THEREFOR

[75] Inventors: Gerritt Bruggink, Hengelo; Jan van der Meulen, Apeldoorn, both of Netherlands

[73] Assignee: Mechinefabriek Wila B.V., Lochem, Netherlands

[21] Appl. No.: 817,906

[22] Filed: Jan. 8, 1992

[30] Foreign Application Priority Data

Jan. 10, 1991 [NL] Netherlands ..... 9100034

[51] Int. Cl.[5] ..... B21D 37/04

[52] U.S. Cl. ..... 72/481; 72/389; 72/462

[58] Field of Search ..... 72/389, 462, 481, 482

[56] References Cited

U.S. PATENT DOCUMENTS

| | | | |
|---|---|---|---|
| 3,779,122 | 12/1973 | Sawvell | 83/698 |
| 4,787,237 | 11/1988 | Houston et al. | 72/462 |
| 5,009,098 | 4/1991 | van Merkstejin | 72/389 |
| 5,042,352 | 8/1991 | Lux | 72/481 |

FOREIGN PATENT DOCUMENTS

| | | | |
|---|---|---|---|
| 0119108 | 1/1984 | European Pat. Off. . | |
| 0237800 | 9/1987 | European Pat. Off. | 72/481 |
| 0256245 | 2/1988 | European Pat. Off. . | |
| 3136440 | 3/1983 | Fed. Rep. of Germany | 72/481 |
| 2122977 | 9/1972 | France . | |
| 2416064 | 8/1979 | France . | |
| 2598946 | 11/1987 | France | 72/481 |
| 57-199523 | 2/1983 | Japan . | |
| 0741999 | 7/1980 | U.S.S.R. | 72/481 |

*Primary Examiner*—David Jones

*Attorney, Agent, or Firm*—Christensen, O'Connor, Johnson & Kindness

[57] ABSTRACT

The invention relates to a press tool with a receiving structure end for receiving into a receiving structure of a folding press, which end is connected via a central portion to a tool end, comprising at least one safety member which can protrude out of a side surface of the receiving structure end, to an adaptor therefor and to a press equipped therewith.

17 Claims, 5 Drawing Sheets

PRESS TOOL AND AN ADAPTOR AND A PRESS THEREFOR

FIELD OF THE INVENTION

The present invention relates to a press tool which can be received in a receiving structure of a folding press.

BACKGROUND OF THE INVENTION

One or a number of press tools is clamped in the lower beam or in the upper beam of a press and thus form the lower tooling and upper tooling respectively. It must preferably be possible to use the separate press tools in random combinations and the tools must be entirely exchangeable and replaceable.

In preference the press tools are self-positioning and closed form-fitting and force-absorbing in the receiving structure.

SUMMARY OF THE INVENTION

The invention relates to a press tool that is exchangeable not only horizontally (in lengthwise direction of the upper and lower beams respectively) but also vertically (in the plane of the upper and lower beams respectively). Also according to the invention is that, after clamping of the tool is deactivated, the press tool cannot be unintentionally released, particularly from the upper beam.

It is characteristic for the press tool according to the invention that the actuable safety members are incorporated in the press tool so that it is not necessary to provide the upper beam and optionally the lower beam with safety members along the whole length. It is herein further ensured that after deactivation of the clamping of the tool to the upper beam or lower beam the press tool is horizontally displaceable but only vertically exchangeable after conscious actuation of the safety member.

The press tool according to the invention is therefore also characterized in that the receiving structure end which is intended to be received in the receiving structure of the press and is connected via a central portion to a tool end comprises at least one safety member which can protrude out of a side surface of the receiving structure end.

After being incorporated in the receiving structure the safety member protruding from the side surface will lie in a longitudinal groove arranged in the receiving structure, whereby the press tool is locked against shifting in vertical direction.

Although actuation of the safety member can take place electrically, pneumatically, hydraulically and even remotely, it is recommended that the safety member can be mechanically actuated by the user who wishes to place the press tool in a receiving structure or remove it therefrom. It is therefore recommended that the safety member is coupled to an actuating member arranged in the central portion and preferably lies in a side surface of the central portion.

The actuating member is accessible at all times if more preferably the actuating member protrudes from a side surface of the central portion.

Damage to the tool can further be avoided if in preference the side surface of the receiving structure end from which the safety member can protrude and the side surface of the central portion in which the actuating member lies are located on the same side of the press tool. It can also be advantageous to be able to directly observe whether the safety member functions when the actuating member is operated.

According to another embodiment it is possible to actuate the safety member with preferably two separate actuating members which in this case are each located in a different side surface of the central portion.

As the length of the press tool increases it is recommended that the press tool has at least two safety members arranged spread over the length of the tool, in which case each safety member is preferably actuable with a separate actuating member.

The press tool according to the invention can be an edge tool as well as a groove tool. Both can be used in the upper beam as well as in the lower beam depending on the products for bending.

Another aspect of the present invention relates to an adaptor which can be used in order to make an existing press suitable for the use of the above described press tools according to the invention. The adaptor according to the invention is provided with a receiving structure which comprises at least one longitudinal groove for receiving a safety member of a press tool according to the invention incorporated in the receiving structure.

In the case the press tools are asymmetrical it is recommended to provide the receiving structure with two longitudinal grooves located mutually opposite.

Another aspect of the invention relates to a folding press according to the invention which is suitable for use of the press tools according to the invention. Such a press according to the invention is provided with a receiving structure which comprises at least one longitudinal groove for receiving the safety member of a press tool according to the invention incorporated in the receiving structure. In preference the receiving structure of this press tool is likewise provided with two longitudinal grooves located mutually opposite.

The invention finally relates to a folding press provided with an adaptor according to the invention in which can be received press tools according to the invention.

Mentioned and other features of the press tool, the adaptor and the press according to the invention will be elucidated hereinafter purely by way of illustration in the light of non-limitative embodiments, wherein reference is made to the annexed drawings.

DETAILED DESCRIPTION OF THE PREFERRED EMBODIMENT

Figure 1:
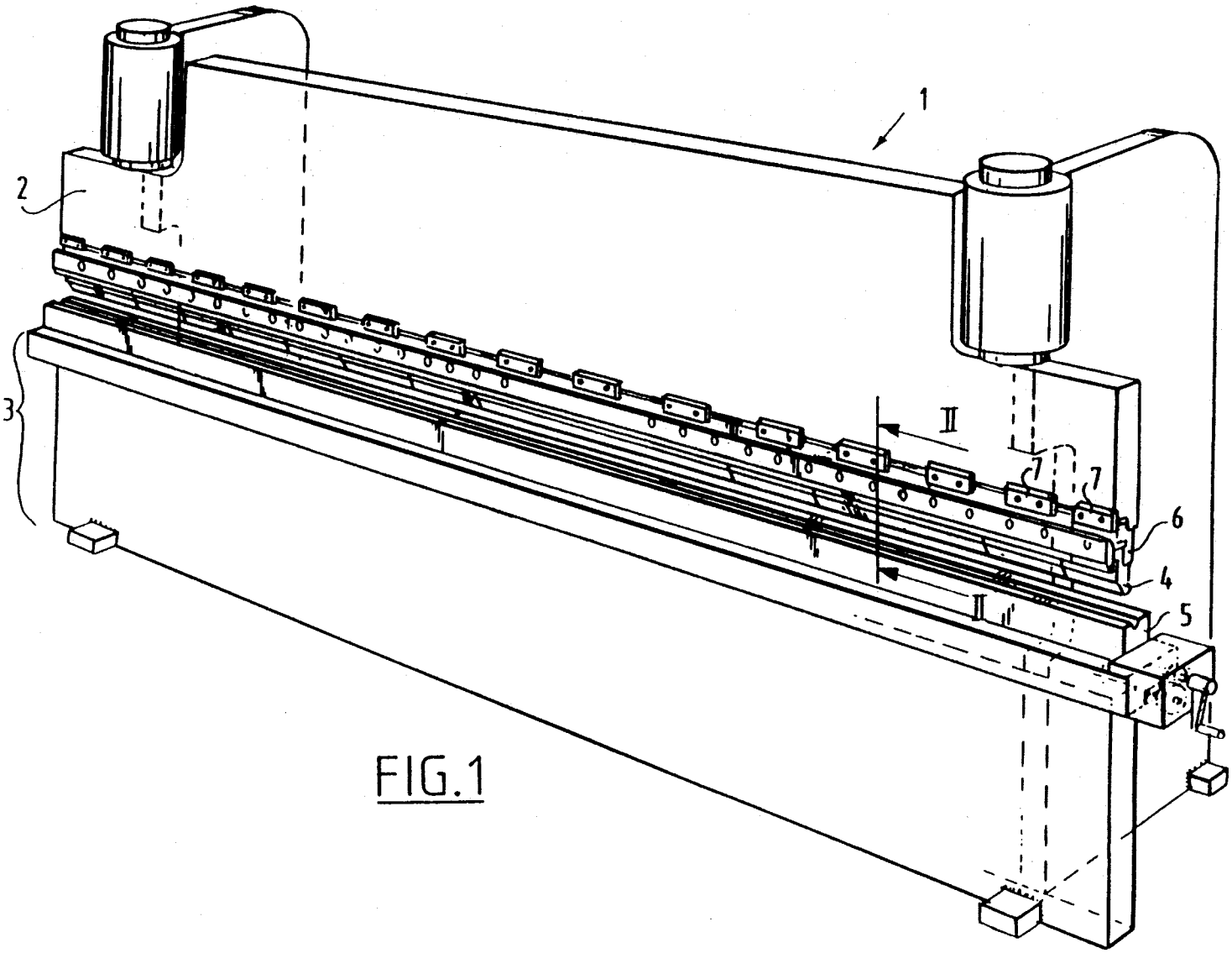
FIG. 1 shows a perspective view of a press according to the invention.

FIG. 1 shows a press 1 according to the invention with an upper beam 2 and a lower beam 3. The upper beam 2 is provided with a series of edge tools 4 according to the invention and the lower beam 3 with a series of groove tools 5 according to the invention. The press 1 otherwise has a known construction, wherefor reference is made to U.S. Pat. No. 5,009,098, the disclosure of which is hereby incorporated by reference herein.

Figure 2:
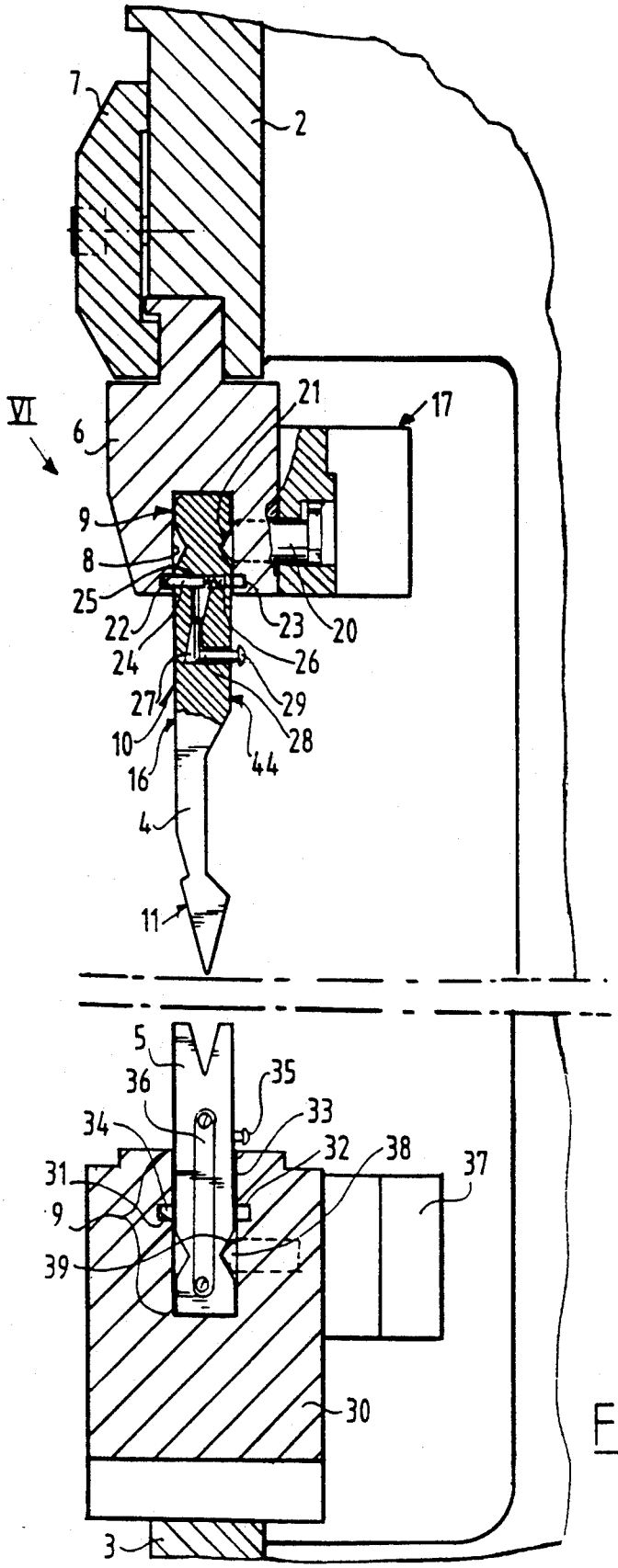
FIG. 2 is a section along the line II—II in FIG. 1.

As shown in FIG. 2, a receiving structure 6 is clamped fixedly on the upper beam 2 using clamping pieces 7.

The receiving structure 6 is provided with a channel 8 in which a receiving structure end 9 of the press tool 4 is received in form-fitting and force-absorbing manner. The receiving structure end 9 is joined via a central portion 10 to a tool end 11.

Figure 3:
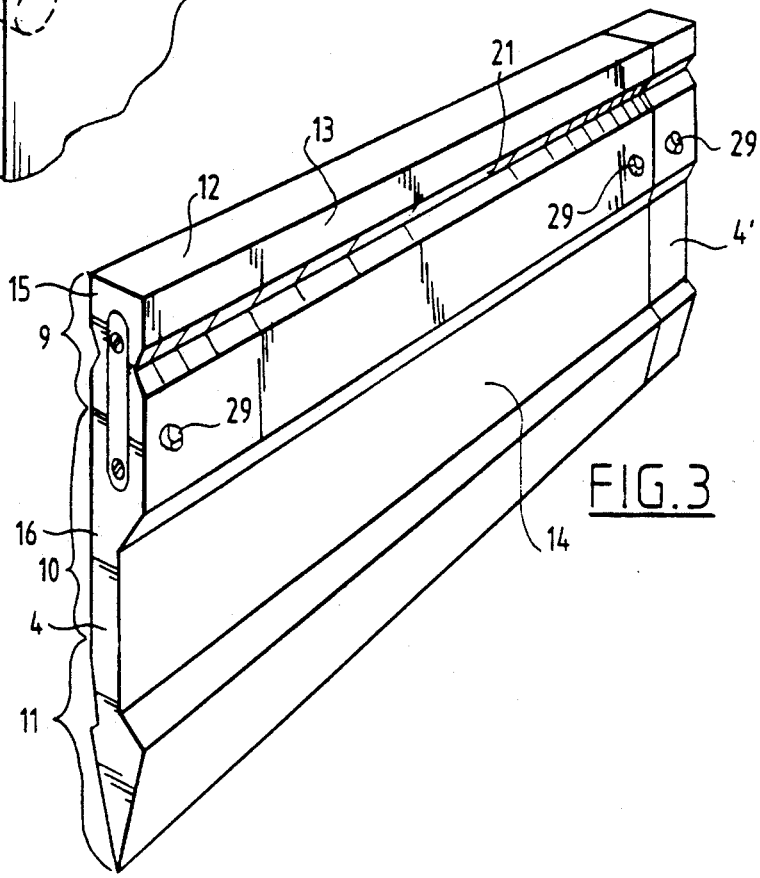
FIGS. 3 and 4 each show a perspective view of press tools according to the invention.

As shown in FIG. 3, the asymmetrical edge tool 4 has a pressure face 12, a reference face 13 on the side surface 14 and a reference face 15 on the side surface 16. Using a known clamping unit 17 which comprises a number of adjacently positioned, reciprocally movable clamping pins 20 which engage onto a clamping face 21 of the edge tool 4 the latter is positioned and centered since during clamping the pressure face 12 and the reference face 15 will fit intimately against the receiving structure 6. It will be apparent that for the clamping unit 17 any suitable mechanical, pneumatic, electrical, hydraulic or similar clamping unit can be used for clamping the edge tool in the receiving structure 6.

The channel 8 of the receiving structure 6 is further provided with two oppositely located longitudinal grooves. Protruding into the longitudinal groove 22 is a safety member 24 according to the invention. The safety member is slidable in a bore 25 and constrained outward by a spring 26. Via a rod 28 located in a channel 27 the safety member 24 is connected to an actuating member 29 lying in the central portion 10 of the edge tool 4 and in the side surface 14 remote from the side surface 16 from which the safety member 24 protrudes.

In similar manner the lower beam 3 is provided with a receiving structure 30 having a channel 33 provided with two longitudinal grooves 31 and 32 for receiving the groove tool 5. Protruding into the longitudinal groove 31 is a safety member 34 of the groove tool 5 that is actuable by means of an actuating member 35. A channel (not shown) in which is located a rod connecting the actuating member 35 to the safety member 34 is accessible via a removable cover 36. Using a known clamping unit 37 the groove tool 5 is clamped and positioned in the receiving structure 30 by a series of clamping pins 38 which engage on the clamping face 39.

Figure 4:
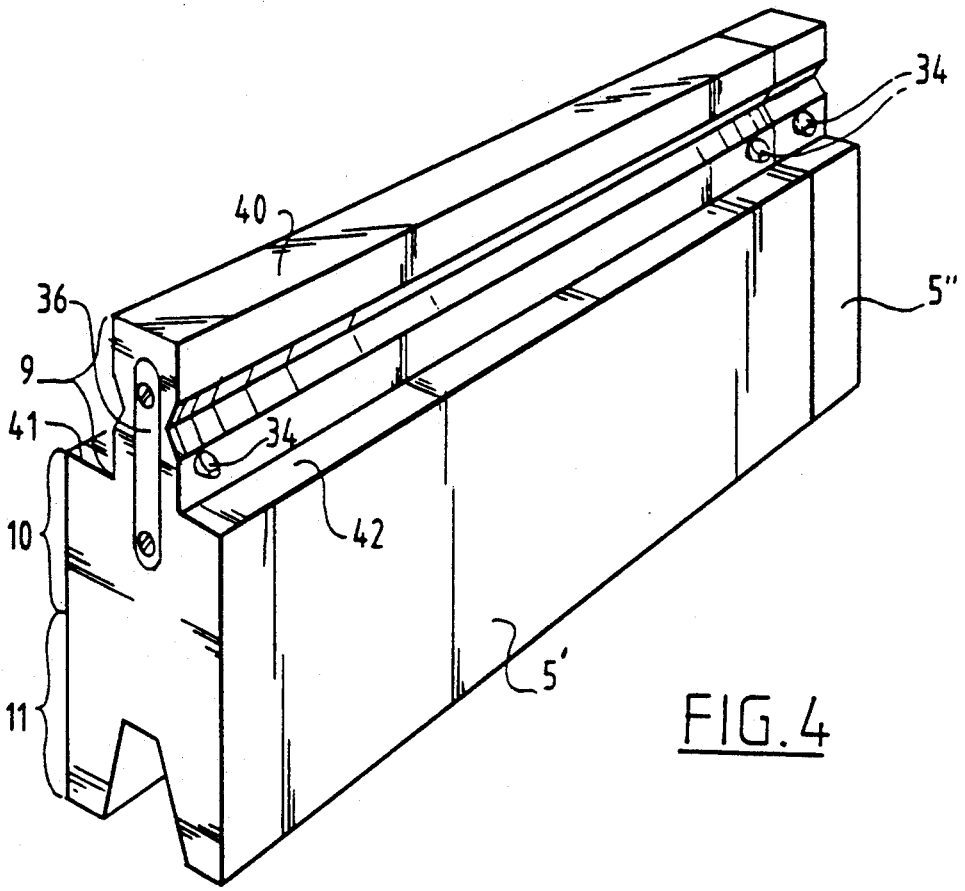

A variant of the groove tool 5 is shown in FIG. 4. The groove tool 5' has in addition to the pressure face 40 two shoulders 41 and 42 which can be employed as pressure faces 41, 42 instead of the face 40. It can be seen clearly once again that the receiving structure end 9 is provided with the safety member 34 according to the invention.

Further shown in FIG. 3 is a short edge tool 4' which is therefore provided with only one safety member according to the invention and therefore with only one actuating member 29.

In similar manner FIG. 4 shows a relatively short groove tool 5'' with only one safety member 34.

The press tools 4 and 5 according to the invention can generally have a length to a point such that their weight becomes too great for vertical exchanging. A maximum weight for manual exchanging amounts to roughly 10-15 kg. The length of the tools is thereby usually restricted to for instance 40-60 cm.

Vertical exchanging of the press tool 4 according to the invention takes place as follows. After removal of the clamping force of the clamping pins 20 the press tool 4 rests with the safety members 24 in the longitudinal groove 22 of receiving structure 6. By pressing in the actuating member 29 the safety member 24 is withdrawn inside the side surface 16 and the receiving structure end 9 can leave the receiving structure 6 because the clamping pins 20 spring back temporarily, while the clamping face 21 slides along the pin. It will be apparent that after removal of the clamping force the tool 4 is displaceable horizontally (perpendicularly of the plane of the drawing), wherein the safety members 24 act as guide pins.

The groove tool 5 can be exchanged in similar manner.

In principle the safety member 34 according to the invention for the groove tool 5 could be dispensed with for use on the lower beam 3 as shown in FIG. 2.

Figure 5:
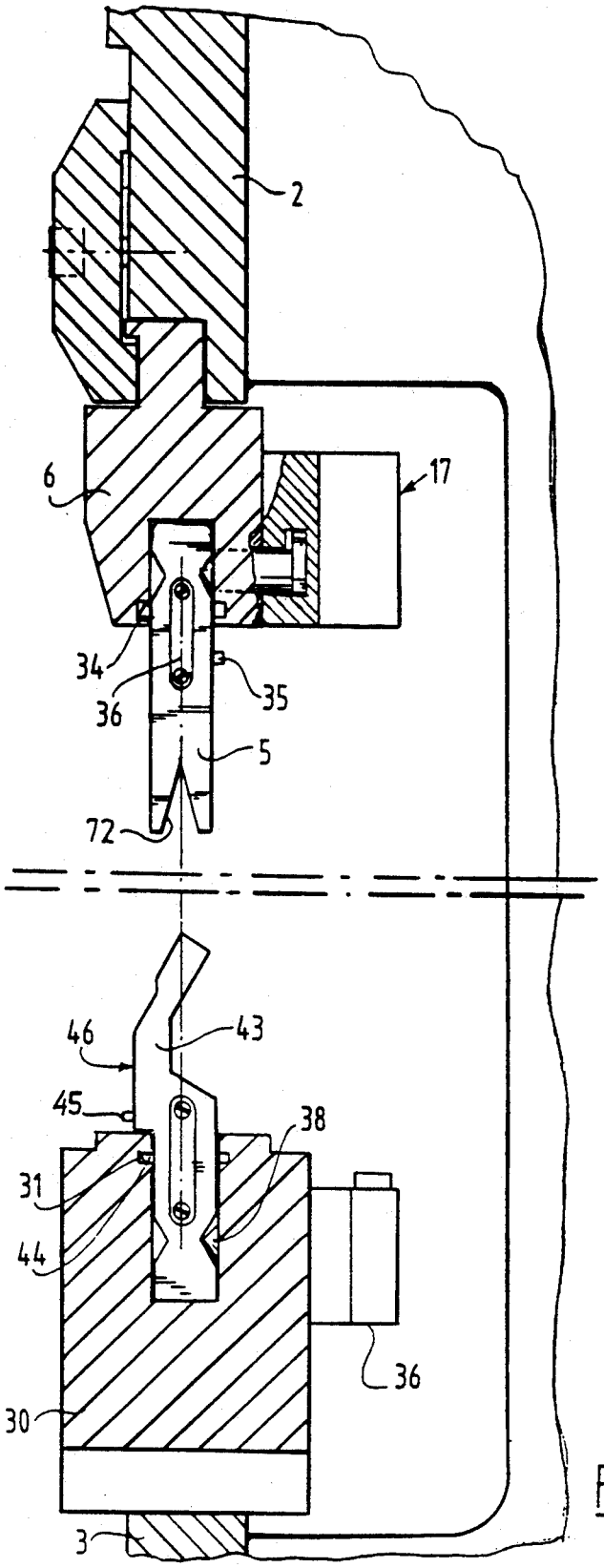
FIG. 5 shows a variant of the section of FIG. 2.

FIG. 5 however shows a situation wherein the groove tool 5 is used on the upper beam 2 and now co-acts with another edge tool 43 according to the invention that is arranged in receiving structure 30. The groove tool 5 includes a groove 72 in the tool end that co-acts with the edge tool 43.

The edge tool 43 is likewise provided with a safety member 44 which protrudes into the longitudinal groove 31 and is actuable with the actuating member 45 which is located with the safety member 44 in the same side surface 46 of the edge tool, 43.

Figure 6:
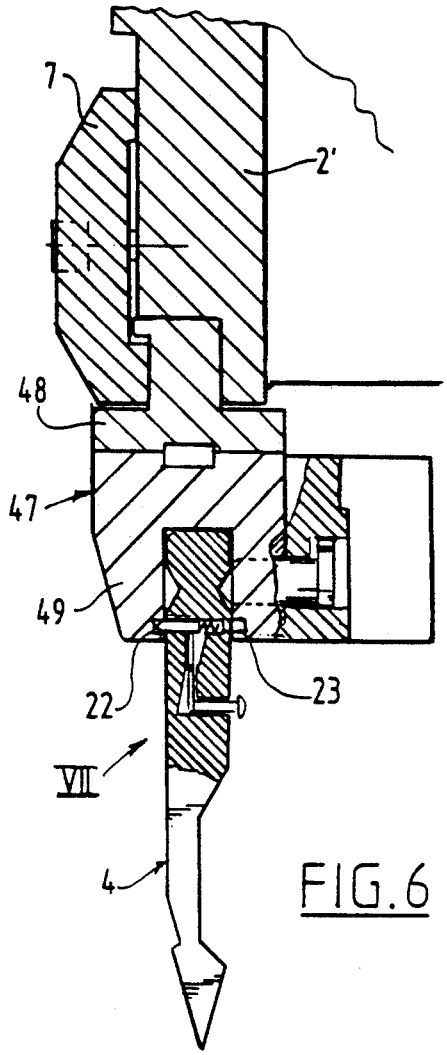
FIG. 6 shows a variant of detail VI of FIG. 2.

FIG. 6 differs from the situation shown in FIG. 2 in the sense that a different type of upper beam 2' is used. The edge tool 4 according to the invention can nevertheless be used since use is made of an adaptor 47 according to the invention. The adaptor has a variable adaptor part 48 that is adaptable in each case to the upper beam 2 or 2' and an adaptor part 49 according to the invention provided with two longitudinal grooves 22 and 23. The adaptor parts 48 and 49 can form one entity or be mutually joined with connecting means. It is thus possible to adapt existing presses in simple manner to the press tools 4 and 5 according to the invention.

In the case of the press tools 4 and 5 the safety members and actuating members are situated on mutually remote side surfaces. In the edge tool 43 the safety member and the actuating member lie on the same side surface.

Figure 8:
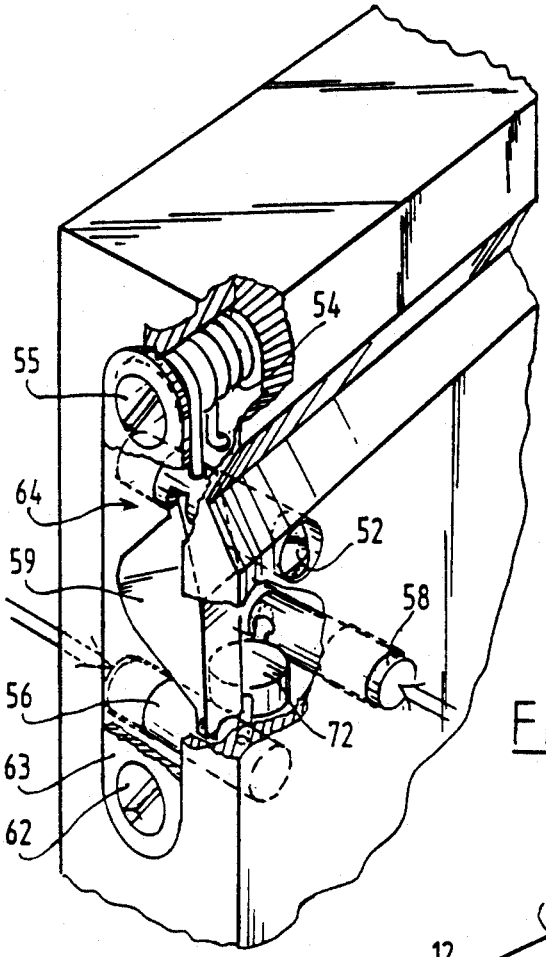
FIG. 8 shows on a larger scale a perspective of the section of FIG. 7.
Figure 7:
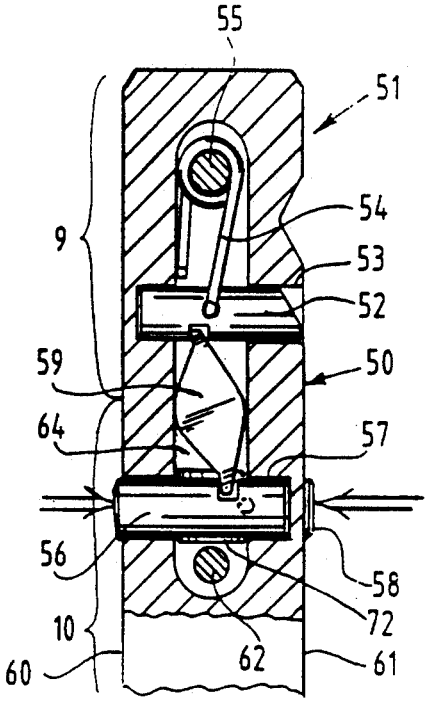
FIG. 7 shows on a larger scale a variant of detail VII of FIG. 6.

FIGS. 7 and 8 show another construction of the upper portion 50 of a press tool 51. The safety member 52 is guided in a bore 53 and is constrained towards the outside by a spiral spring 54 arranged round a pin 55. The actuating member 56 is guided in a bore 57 and the actuating member 58 lies behind the actuating member 56. Both actuating members 56, 58 are coupled via a rotary member 72. Via the coupling piece 59 the actuating member 56 is connected directly and the actuating member 58 indirectly to the safety member 52. The safety member is thus actuable from the side surface 60 and from the side surface 61 remote therefrom.

As shown in FIG. 8, the pins 55 and 62 are used for closing the chamber 64 with a cover 63.

Figure 9:
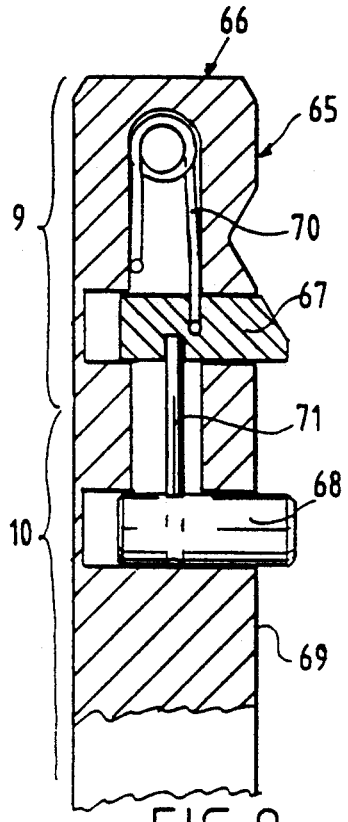
FIG. 9 shows a variant of FIG. 7.

Finally, FIG. 9 shows the upper portion 65 of a press tool 66, wherein the safety member 67 and its actuating member 68 are located on the same side surface 69. The safety member is constrained outward by a spring 70 and coupled via a coupling element 71 to its actuating member 68.

The embodiments of the invention in which an exclusive property or privilege is claimed are defined as follows:

1. In a folding press having a receiving structure for receiving a press tool having a receiving end, a central portion and a tool end, the improvement comprising at least one safety member operatively mounted in the receiving end such that the safety member protrudes out of a side surface of the receiving end and releasably engages the receiving structure such that the press tool is prevented from unintentionally disengaging the receiving structure, the safety member being coupled to an actuating member, operatively mounted in the central portion, so that actuation of the actuating member disengages said safety member from the receiving structure.

2. The improved press as claimed in claim 1, wherein the actuating member is located in a first side surface of the central portion.

3. The improved press as claimed in claim 2, wherein the actuating member protrudes from the first side surface of the central portion.

4. The improved press as claimed in claim 3, wherein the first side surface of the central portion and the side surface of the receiving end are located on a first side of the press tool.

5. The improved press as claimed in claim 2, wherein the actuating member protrudes from the first side surface of the central portion and from a second side surface of the central portion opposite the first side surface.

6. The improved press as claimed in claim 1, wherein said safety member is located along a length of the tool.

7. The improved press as claimed in claim 6, wherein said safety member is actuable with a separate actuating member.

8. The improved press as claimed in claim 1, wherein the press tool is a groove tool, including a groove located in the tool end.

9. The improved press as claimed in claim 1, wherein the receiving structure further comprises an adapter adapted to be attached to the folding press, the adapter having at least one longitudinal groove for receiving said safety member.

10. The improved press as claimed in claim 9, wherein the adaptor has two longitudinal grooves located on mutually opposite sides of the adapter.

11. The improved press as claimed in claim 9, wherein the receiving end is received in the adapter.

12. The improved press as claimed in claim 1, wherein the receiving structure further comprises at least one longitudinal groove for receiving said safety member.

13. The improved press as claimed in claim 12, wherein the receiving structure has two longitudinal grooves located on mutually opposite sides of the receiving structure.

14. A press tool adapted to releasably engage a receiving structure in a press, the press tool comprising: a body having a receiving end, a central portion, and a tool end; and releasable safety means operatively mounted in the receiving end and protruding out of a side surface of the receiving end for releasably engaging the receiving structure so as to prevent unintentional disengagement of the press tool from the receiving structure, the releasable safety means including actuating means, operatively mounted in the central portion, for disengaging the safety means from the receiving structure.

15. The press tool of claim 14, wherein the safety means protrudes from opposing surfaces of the receiving end of the press tool.

16. The press tool of claim 14, wherein the receiving structure further comprises an adaptor adapted to be attached to a press, the adaptor including at least one longitudinal groove for receiving said safety means.

17. The press tool of claim 16, wherein the adaptor includes two longitudinal grooves located on mutually opposite sides of the adaptor.

* * * * *

UNITED STATES PATENT AND TRADEMARK OFFICE

CERTIFICATE OF CORRECTION

PATENT NO. : 5,245,854

DATED : September 21, 1993

INVENTOR(S) : G. Bruggink et al.

It is certified that error appears in the above-indentified patent and that said Letters Patent is hereby corrected as shown below:

| COLUMN | LINE | |
|---|---|---|
| Title page, item [75] "Inventors" | 1 | "Gerritt Bruggink" should read --Gerrit Bruggink-- |
| item [56] "U.S. Patents" | 3rd Ref. | "5,009,098 4/1991 van Merkstejin" should read --5,009,098 4/1991 van Merksteijn-- |
| item [56] "Foreign Patents" | 8th Ref. | "57-199523 2/1983 Japan" should read --57-198523 2/1983 Japan-- |

Signed and Sealed this

Twenty-sixth Day of April, 1994

Bruce Lehman

*Attest:*

BRUCE LEHMAN

*Attesting Officer*

*Commissioner of Patents and Trademarks*